US005096086A

United States Patent [19]

Crema

[11] Patent Number: 5,096,086

[45] Date of Patent: Mar. 17, 1992

[54] REFUSE CONTAINER APPARATUS

[76] Inventor: Marion E. Crema, 500-334B Peconic St., Ronkonkoma, N.Y. 11779

[21] Appl. No.: 668,230

[22] Filed: Mar. 12, 1991

[51] Int. Cl.[5] ..... B65D 1/24; B65F 7/00

[52] U.S. Cl. ..... 220/533; 220/909; 220/532; 220/404; 220/334; 220/87.1

[58] Field of Search ..... 220/909, 404, 334, 324, 220/532, 533, 87.1

[56] References Cited

U.S. PATENT DOCUMENTS

| | | | |
|---|---|---|---|
| 1,963,236 | 6/1934 | Kastle | 220/324 |
| 2,025,932 | 12/1935 | Beldin | 220/404 |
| 3,200,983 | 8/1965 | Walter | 220/533 |
| 3,767,110 | 10/1973 | Congleton | 220/324 |
| 4,157,146 | 6/1979 | Svenson | 220/324 |
| 4,268,392 | 5/1981 | Hayes | 220/404 |
| 4,782,977 | 11/1988 | Watanabe et al. | 220/324 |
| 4,834,262 | 5/1989 | Reed | 220/404 |
| 4,867,328 | 9/1989 | McCarthy | 220/909 |
| 4,905,853 | 3/1990 | Strawder | 220/909 |

*Primary Examiner*—Stephen P. Garbe
*Assistant Examiner*—S. Castellano
*Attorney, Agent, or Firm*—Leon Gilden

[57] ABSTRACT

A refuse container wherein removable partitions permit adjustment of compartments therewithin, wherein each of the partitions permit securement of trash bags of a typical polymeric configuration and construction to position within each compartment. Hook members are mounted to a plurality of side walls of the container and extend exteriorly above an upper edge of the container walls to cooperate with selective apertures directed through a lid. In this manner, the lid is pivotal about one of a plurality of pairs of such hook members when remaining hook members are removed. A modification of the invention includes reservoirs and back securement members positionable over upper edges of the container to secure selective bags within the container, wherein the securement members include reservoirs to permit adding of various insecticides and fumigants within the containers during use.

3 Claims, 4 Drawing Sheets

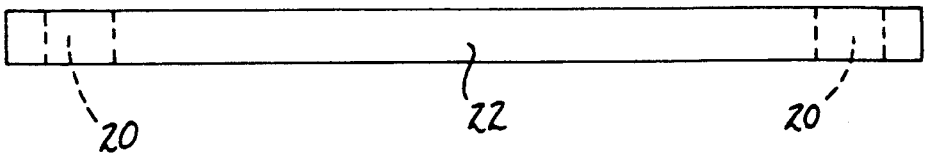
Fig 3
Fig 4
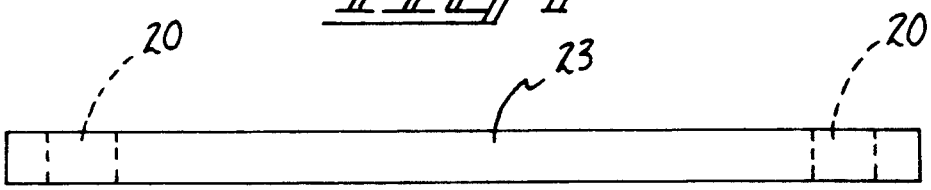
Fig 5
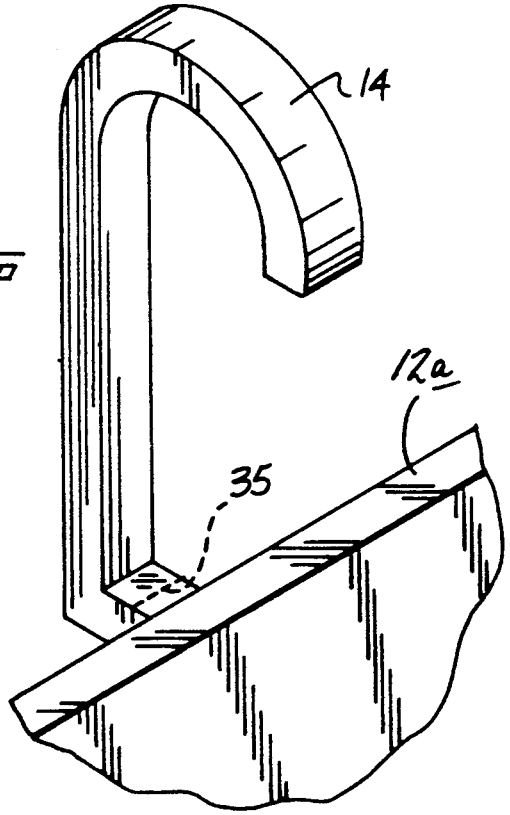

REFUSE CONTAINER APPARATUS

BACKGROUND OF THE INVENTION

1. Field of the Invention

The field of invention relates to refuse containers, and more particularly pertains to a new and improved refuse container apparatus wherein the same is utilized for separation of articles into components such as glass, plastic, aluminum cans, and the like.

2. Description of the Prior Art

Receptacles of various types have been utilized in the prior art for selective segregation of various components to permit ease of recycling of various household items such as aluminum cans, plastics, paper, and the like. Examples of such receptacles are found for example in U.S. Pat. No. 3,720,346 to Cypher wherein a compartmented trash can utilizes a cylindrical housing formed with partitions which are rotatably mounted within the container for selective modification of various compartmentally sized containers.

U.S. Pat. No. 3,893,615 to Johnson sets forth a multiple compartment container wherein a linearly aligned trash can includes a series of compartments therewithin.

U.S. Pat. No. 4,874,111 to Heller sets forth a multicompartment refuse container of rigid construction mounting various liners therewithin.

U.S. PatL.No. 4,821,903 to Hayes sets forth a trash can cart and bin wherein a single lid overlies an aligned series of containers.

U.S. Pat. No. 4,801,034 to Sandomeno wherein a receptacle includes various compartments, and each compartment includes a rigidly removable container from each compartment.

As such, it may be appreciated that there continues to be a need for a new and improved refuse container apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of refuse containers now present in the prior art, the present invention provides a refuse container apparatus wherein the same sets forth a multicompartmented container utilizing selectively positionable partitions mounted therewithin for securement of polymeric liners. As such, the general purpose of the present invention, which will be described subsequently in greater detail, is to provide a new and improved refuse container apparatus which has all the advantages of the prior art refuse containers and none of the disadvantages.

To attain this, the present invention provides a refuse container wherein removable partitions permit adjustment of compartments therewithin, wherein each of the partitions permit securement of trash bags of a typical polymeric configuration and construction to position within each compartment. Hook members are mounted to a plurality of side walls of the container and extend exteriorly above an upper edge of the container walls to cooperate with selective apertures directed through a lid. In this manner, the lid is pivotal about one of a plurality of pairs of such hook members when remaining hook members are removed. A modification of the invention includes reservoirs and back securement members positionable over upper edges of the container to secure selective bags within the container, wherein the securement members include reservoirs to permit adding of various insecticides and fumigants within the containers during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved refuse container apparatus which has all the advantages of the prior art refuse containers and none of the disadvantages.

It is another object of the present invention to provide a new and improved refuse container apparatus which may be easily and efficiently manufactured and marketed.

It is a further object of the present invention to provide a new and improved refuse container apparatus which is of a durable and reliable construction.

An even further object of the present invention is to provide a new and improved refuse container apparatus which is susceptible of a low cost of manufacture with regard to both materials and labor, and which accordingly is then susceptible of low prices of sale to the consuming public, thereby making such refuse container apparatus economically available to the buying public.

Still yet another object of the present invention is to provide a new and improved refuse container apparatus which provides in the apparatuses and methods of the prior art some of the advantages thereof, while simultaneously overcoming some of the disadvantages normally associated therewith.

Still another object of the present invention is to provide a new and improved refuse container apparatus wherein the same provides a multi-compartmented refuse container including securement members mounted to upper terminal edges of each compartment for permitting selective release of various insecticide and fumigant within each container liner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 2 in the direction indicated by the arrows.

FIG. 4 is an orthographic view, taken along the lines 4—4 of FIG. 2 in the direction indicated by the arrows.

FIG. 5 is an isometric illustration of section 5 as set forth in FIG. 1.

DESCRIPTION OF THE PREFERRED EMBODIMENT

Figure 1:
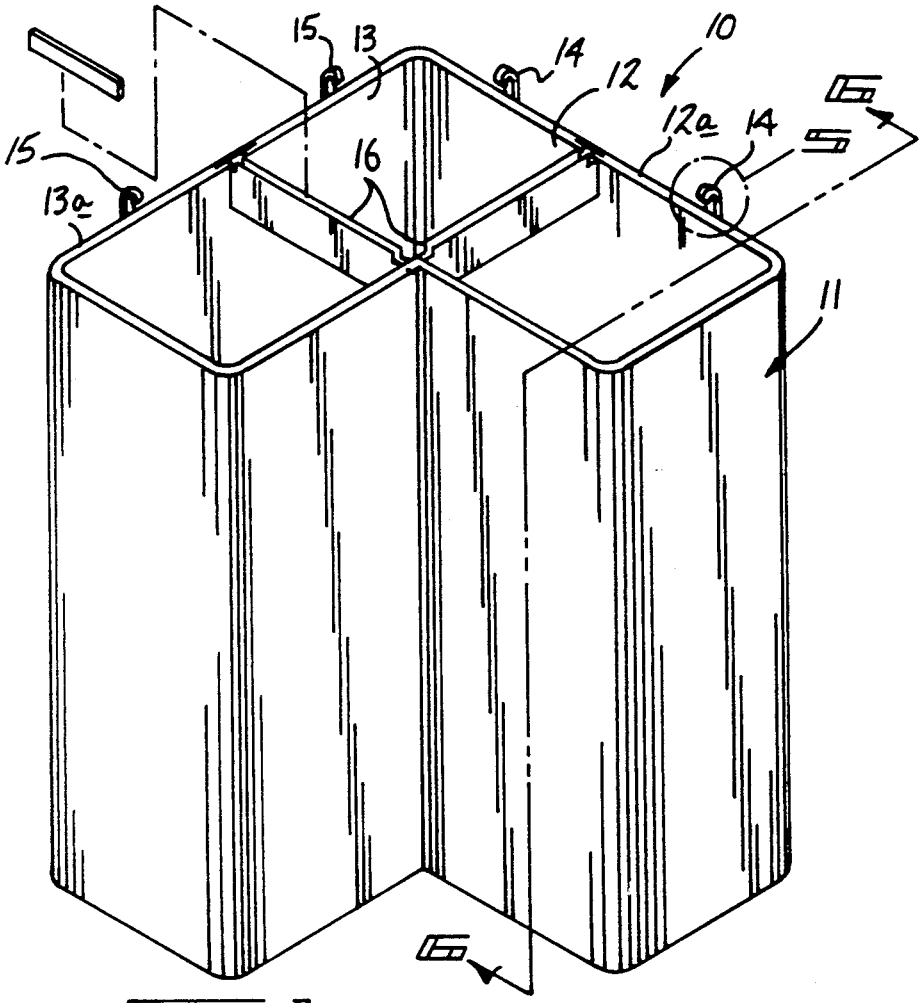
FIG. 1 is an isometric illustration of the instant invention.
Figure 2:
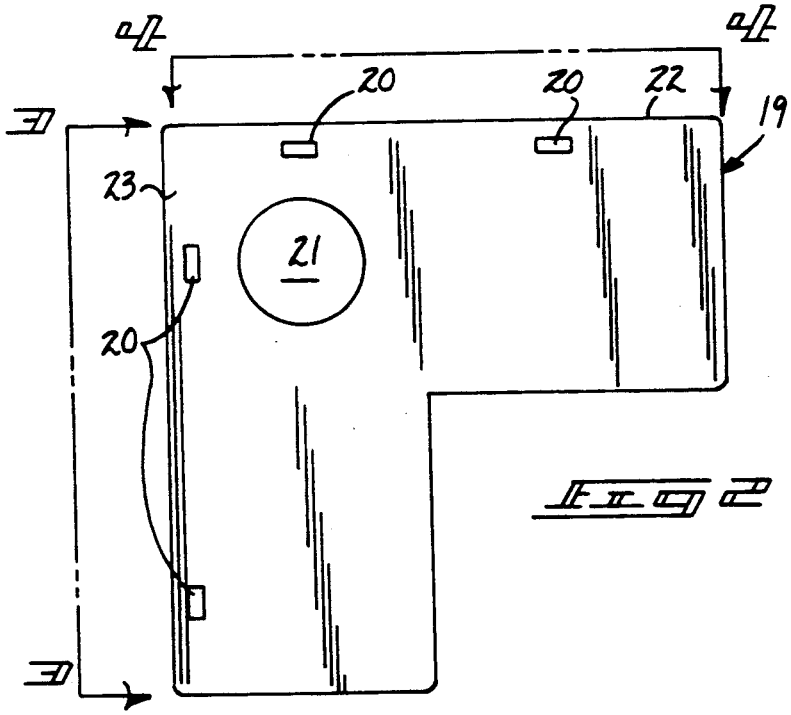
FIG. 2 is an orthographic top view of the lid utilized by the instant invention.
Figure 6:
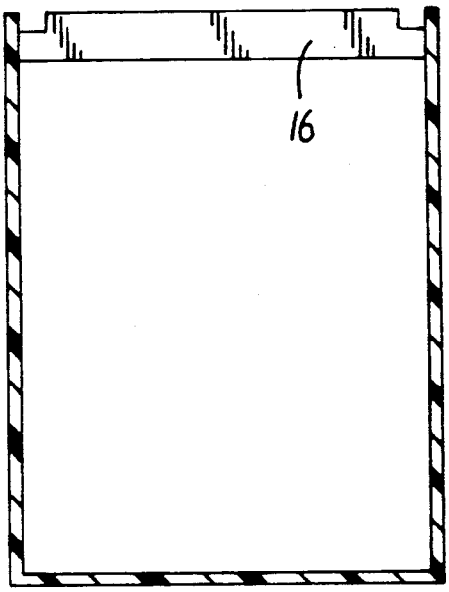
FIG. 6 is an orthographic view, taken along the lines 6—6 of FIG. 1 in the direction indicated by the arrows.
Figure 7:
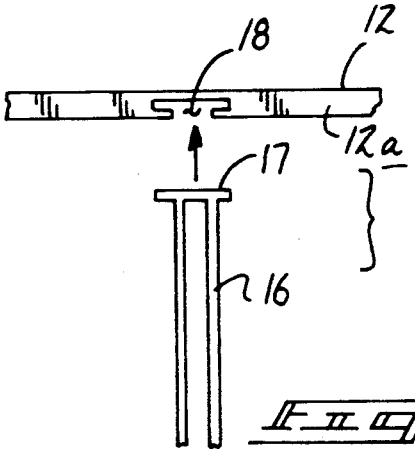
FIG. 7 is an orthographic top view of a partition mounted within an associated side wall slot.

With reference now to the drawings, and in particular to FIGS. 1 to 11 thereof, a new and improved refuse container apparatus embodying the principles and concepts of the present invention and generally designated by the reference numeral 10 will be described.

More specifically, the refuse container apparatus 10 of the instant invention essentially comprises a vertical container 11 defined by an internal cavity and vertically disposed side walls, including a first side wall 12 and a second side wall 13, as illustrated in FIG. 1 defining an "L" shaped container. The first side wall 12 includes a first side wall top edge 12*a*, wherein the second side wall 13 includes a second side wall top edge 13*a*. As illustrated, opposed side walls to the first and second side walls define the enclosure, wherein the first side wall 12 includes an opposed first side wall, and the second side wall 13 for example utilizes an opposed second side wall.

First hinge hooks 14 spaced apart a predetermined spacing are mounted to an exterior surface of the first side wall 12, wherein the first hooks 14 project above the first side wall top edge 12*a*, with the upper end hook portion extending interiorly of the container 11. Similarly, second hinge hooks 15 oriented along the second side wall 13, that is in itself oriented at 90 degrees relative to the first side wall, mounts the second hinge hooks 15 to orient the second hinge hooks 15 above the second side wall top edge projecting interiorly of the container. Reference to FIG. 5 illustrates that each of the hooks 14 includes a frangible connection 35 adjacent each exterior surface of each side wall to permit manual removal of selective hinge hooks. A lid 19 (see FIG. 10) includes a lid first edge 22 and a lid second edge 23, with a plurality of lid openings 21 directed orthogonally through the lid adjacent the respective first and second edges 22 and 23, wherein the lid openings 21 are spaced apart a predetermined spacing equal to the predetermined spacing spaced apart by the first and second hinge hooks 14 and 15. Accordingly, the lid 19 may be pivotally mounted about either the first or second hinge hooks selectively, wherein the unused hinge hooks are removed about their respective frangible connections 35 to permit pivotment of the lid about the first edge 22 or the second edge 23. A lid opening 21 is directed through the lid to permit directing of various refuse therethrough, such as bottles and the like if desired.

Partition members 16 defined by parallel plates are provided, wherein each of the partition members 16 includes an end plate 17 orthogonally mounted to each terminal end of each partition member 16 to permit positioning of each end plate 17 within a respective dove tail slot 18 mounted within each of the first and second side walls, as well as the first and second opposed side walls to permit positioning of the partitions within the container. It should be noted that a plurality of such opposed dove tail slots 18 may be provided to permit positioning of the partition member 16 as desired within the container.

Figure 8:
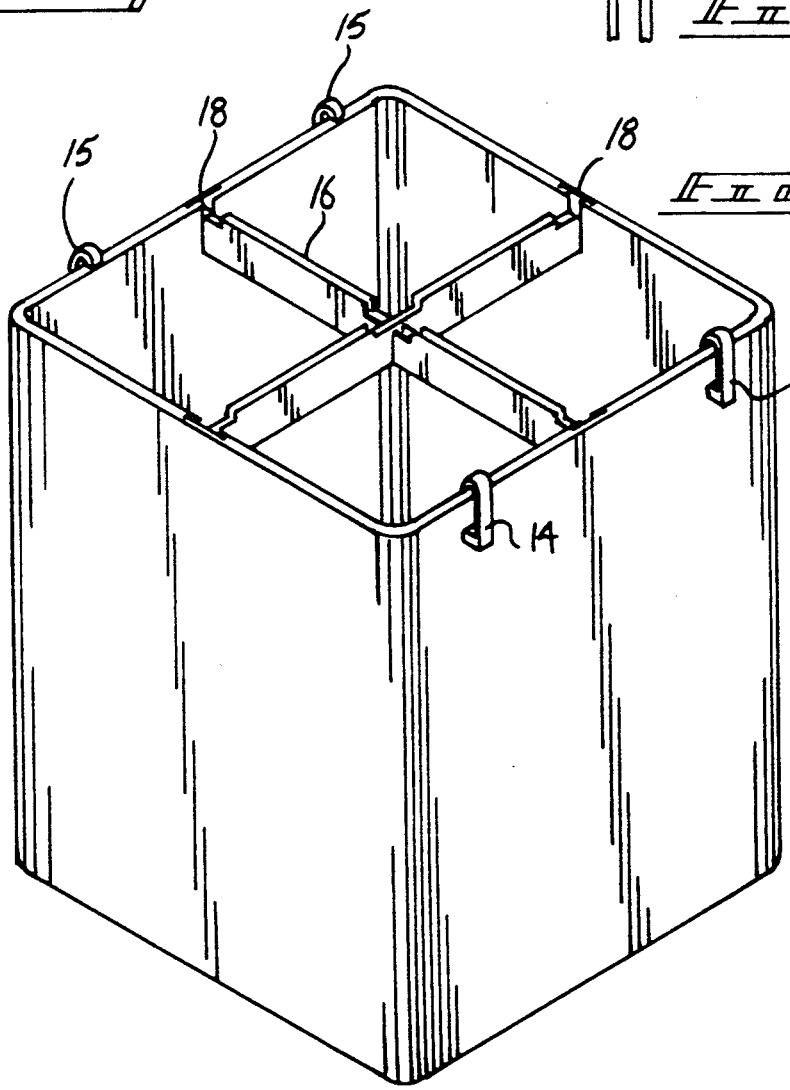
FIG. 8 is an isometric illustration of a modified refuse container bin of a rectangular configuration.

FIG. 8 illustrates the use of a rectangular container incorporating the salient features of the instant invention.

Figure 9:
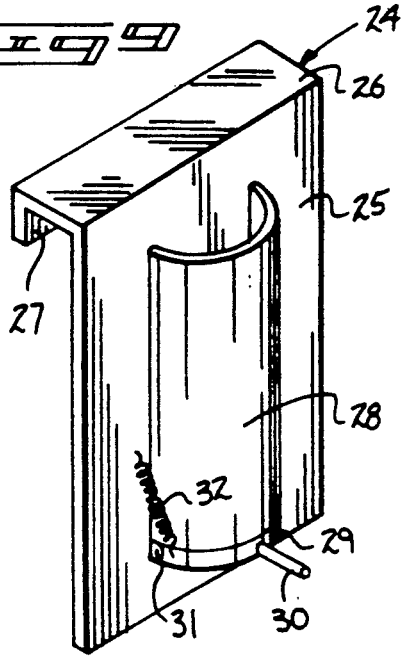
FIG. 9 is an isometric illustration of a securement member utilized by the instant invention.
Figure 10:
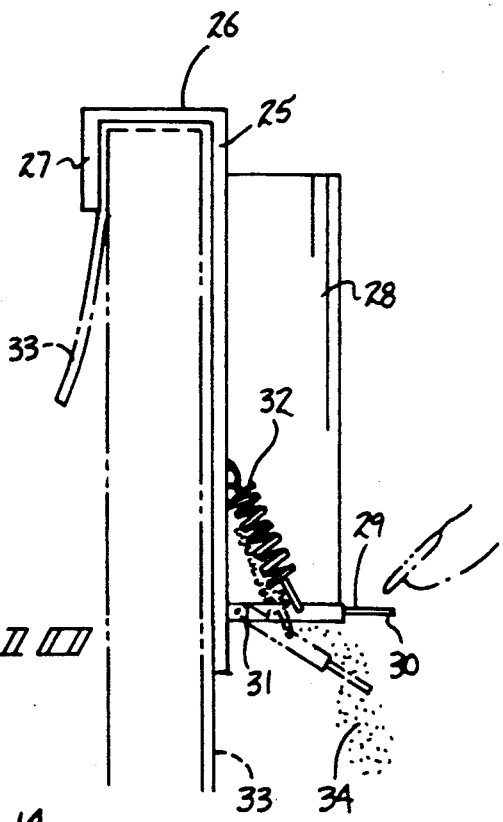
FIG. 10 is an orthographic cross-sectional illustration of the securement member mounted to the associated container.
Figure 11:
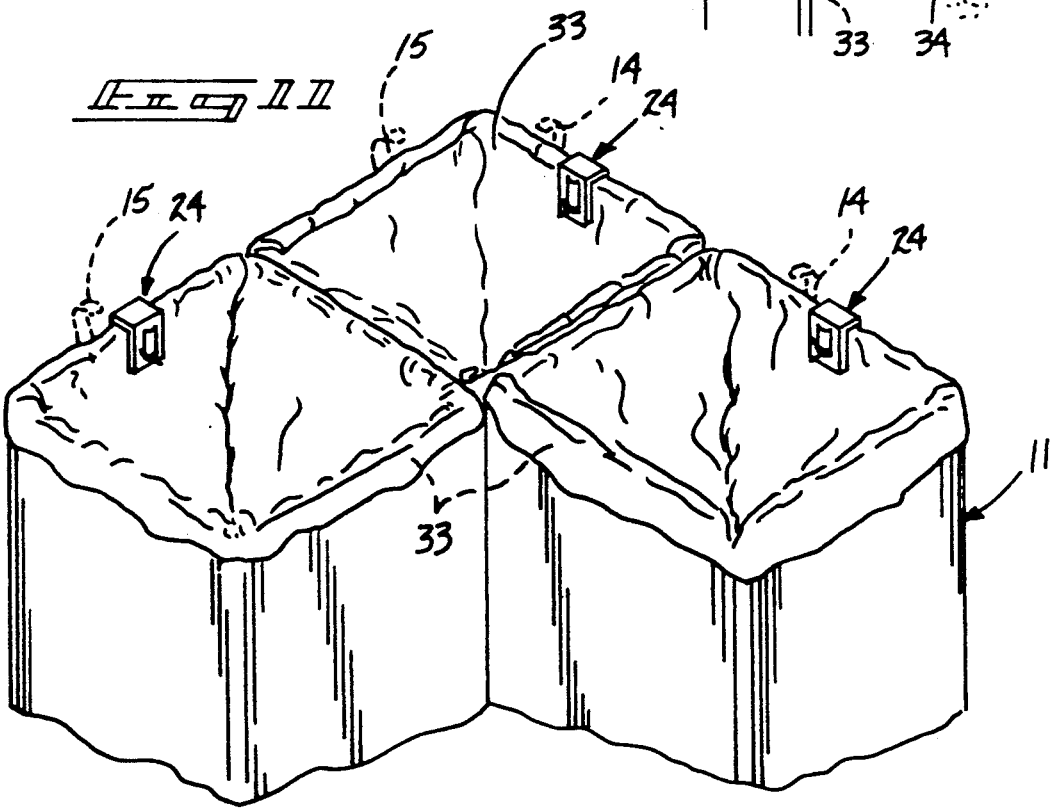
FIG. 11 is an isometric illustration of the securement members in association with the refuse container of the instant invention.

FIGS. 9–11 illustrates the use of a securement member 24 to secure a respective polymeric bag member 33 within each compartment defined by the partition member 16 and the container 11 as disclosed by FIGS. 1–7. The securement member 24 is formed by a frontal support plate 25 that extends parallel and contiguously to each respective side wall on an interior surface thereof, with a top plate leg 26 overlying a respective top edge of a respective wall, and a rear plate leg 27 that is positioned parallel to the frontal support plate 25 and orthogonally and integrally mounted to the top leg 26. A semi-cylindrical reservoir 28 is fixedly and vertically mounted upon a forward surface of the frontal support plate 25 and includes a pivotally mounted reservoir bottom plate 29 positioned in contiguous communication with a bottom edge of the semi-cylindrical reservoir 28. The reservoir bottom plate 29 includes a handle 30 projection radially and exteriorly of the bottom plate 29, with a hinge 31 mounted to the bottom plate 29 at an intersection of the bottom plate and the frontal support plate 25. A return spring 32 mounted to the frontal support plate 25 and the bottom plate 29 resiliently biases the bottom plate 29 into communication with the bottom edge of the semi-cylindrical reservoir 28. Depressing of the handle 30 spaces the bottom plate 29 permitting dispersion of a quantity of powdered insecticide and fumigant 34 from the reservoir 28 into an associated bag member 33.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A refuse container apparatus comprising, a container member including a continuous side wall organization, including a first side wall orthogonally oriented relative to a second side wall, the first side wall including a first side wall top edge and the second side wall including a second side wall top edge, and a plurality of first hinge hooks mounted to an exterior surface of the first side wall extending above the first side wall top edge, wherein the first hinge hooks are spaced apart a predetermined spacing, and a plurality of second hinge hooks mounted to an exterior surface of the second side wall projecting above the second side wall top edge spaced apart the predetermined spacing, and a lid member, the lid member including a lid first edge aligned with the first side wall top edge, and a lid second edge aligned with the second side wall top edge, and a plurality of first lid openings spaced apart the predetermined spacing directed through the lid member adjacent the lid first edge and a plurality of further lid openings directed through the lid member adjacent the lid second edge spaced apart the predetermined spacing, and at least one partition member mounted within the container orthogonally oriented and directed between opposed side walls, and wherein the opposed side walls include at least the first side wall and an opposed first side wall spaced from and parallel to the first side wall, wherein each of the first side wall and the opposed first side wall include a dove tail slot directed longitudinally of each said first side wall and said opposed first side wall, and the partition member includes end plates orthogonally mounted to each end of the partition member, wherein each end plate is receivable within a respective dove tail slot of said first side wall and said opposed first side wall, and wherein each hinge hook includes a frangible connection formed within each hinge hook adjacent said first side wall and said second side wall to permit selective removal of either the second hinge hooks or the first hinge hooks plurality of hinge hooks to permit utilization of the remaining hinge hooks within the first lid openings or the further lid openings respectively of the lid member.

2. An apparatus as set forth in claim 1 wherein a plurality of polymeric bag members are mounted within the container on opposed sides of the partition member, and each polymeric bag member is arranged to extend overlying a respective side wall top edge of said first and second side wall top edges, and a securement member secures each polymeric bag member to each side wall top edge, and each securement member includes a frontal support plate, and a top plate leg orthogonally and fixedly mounted to an upper terminal end of the frontal support plate, and a rear plate leg orthogonally and integrally mounted to the top plate leg spaced from the frontal support plate, wherein each side wall top edge is received between a rear surface of the frontal support plate and the top plate leg and the rear plate leg, and a semi-cylindrical reservoir fixedly mounted to a frontal surface of the frontal support plate orthogonally oriented relative to the top plate leg, and the semi-cylindrical reservoir includes a reservoir bottom plate hingedly mounted to a lower terminal edge of the semi-cylindrical reservoir, with the reservoir bottom plate in contiguous communication with the lower terminal edge of the semi-cylindrical reservoir in a first position, and in a spaced relationship relative to the lower terminal edge of the semi-cylindrical reservoir in a second position, and a handle member mounted to the reservoir bottom plate to permit manual displacement of the reservoir bottom plate from the first position to the second position, and a return spring mounted to the reservoir bottom plate and to the frontal support plate to bias the reservoir bottom plate in the first position.

3. An apparatus as set forth in claim 2 including a powdered insecticide and fumigant contained within the semi-cylindrical reservoir to permit selective deposit of the powdered insecticide and fumigant from each securement member into an associated polymeric bag member.

* * * * *